US010118383B2

(12) United States Patent
Murayama et al.

(10) Patent No.: US 10,118,383 B2
(45) Date of Patent: Nov. 6, 2018

(54) RECORDING APPARATUS AND RECORDING METHOD

(71) Applicant: SEIKO EPSON CORPORATION, Tokyo (JP)

(72) Inventors: Osamu Murayama, Matsumoto (JP); Takehito Washizawa, Shiojiri (JP); Yoshiyuki Konishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/601,879

(22) Filed: May 22, 2017

(65) Prior Publication Data

US 2017/0334200 A1 Nov. 23, 2017

(30) Foreign Application Priority Data

May 23, 2016 (JP) ..... 2016-102169

(51) Int. Cl.

| | |
|---|---|
| ***B41J 11/00*** | (2006.01) |
| ***B41J 2/045*** | (2006.01) |
| ***B41J 11/42*** | (2006.01) |
| ***B41J 2/145*** | (2006.01) |
| ***B41J 2/08*** | (2006.01) |
| ***B41J 2/47*** | (2006.01) |
| ***B41J 29/38*** | (2006.01) |

(52) U.S. Cl.

CPC ..... *B41J 2/04541* (2013.01); *B41J 2/08* (2013.01); *B41J 2/145* (2013.01); *B41J 2/47* (2013.01); *B41J 11/002* (2013.01); *B41J 11/0015* (2013.01); *B41J 11/42* (2013.01); *B41J 29/38* (2013.01)

(58) Field of Classification Search

CPC . B41J 2/04541; B41J 2/08; B41J 2/145; B41J 2/47; B41J 11/0015; B41J 11/002; B41J 11/42; B41J 29/38

See application file for complete search history.

(56) References Cited

U.S. PATENT DOCUMENTS

| | | | | |
|---|---|---|---|---|
| 5,636,011 A * | 6/1997 | Fujiwara | G03G 15/16 | 399/315 |
| 6,097,408 A * | 8/2000 | Fukushima | B41J 2/06 | 347/34 |
| 6,508,540 B1 * | 1/2003 | Lean | B41J 2/06 | 347/104 |
| 2011/0102490 A1 | 5/2011 | Yamada et al. | | |

(Continued)

FOREIGN PATENT DOCUMENTS

| | | |
|---|---|---|
| EP | 2979876 A1 | 2/2016 |
| JP | 2015-024648 | 2/2015 |
| WO | 2006068281 A2 | 6/2006 |

OTHER PUBLICATIONS

European Search Report issued in Application No. 17172446 dated Oct. 11, 2017.

*Primary Examiner* — Anh T. N. Vo

(74) *Attorney, Agent, or Firm* — Workman Nydegger

(57) ABSTRACT

A recording apparatus is provided with a droplet discharging head having a nozzle forming portion and a charging unit. The nozzle forming portion includes nozzles formed therein. The charging unit is configured to impart an electrical charge to the medium. The charging unit imparts, to the medium, an electrical charge having the same polarity as an electrically charged state of the nozzle forming portion after the droplets are discharged.

9 Claims, 9 Drawing Sheets

(56) References Cited

U.S. PATENT DOCUMENTS

| | | | |
|---|---|---|---|
| 2012/0287208 | A1 | 11/2012 | Kobashi et al. |
| 2015/0375532 | A1 | 12/2015 | Tokai et al. |
| 2016/0129701 | A1 | 5/2016 | Suzuki |

* cited by examiner

RECORDING APPARATUS AND RECORDING METHOD

BACKGROUND

1. Technical Field

The present invention relates to a recording apparatus and a recording method.

2. Related Art

In the related art, to remove static electricity occurring in a recording medium, an ink jet printer is known that is provided with a first ionizer that generates positive ions and a second ionizer that generates negative ions, and the positive ions and the negative ions are supplied to the same area of the recording medium (see JP-A-2015-24648, for example).

However, in the above-described ink jet printer, even if the static electricity in the recording medium is removed, when ink (droplets) discharged onto the recording medium is electrically charged, an amount of the ink adhering to the recording medium increases, and as a result, an electrically charged state of the recording medium changes to the side of the polarity of the electric charge of the ink. Thus, for example, when ink mist generated as a result of the discharge of the ink is electrically charged with the same polarity as the electrically charged state of the ink adhered to the recording medium, the ink mist is repelled and a problem arises in which the ink mist adheres to an area (such as a margin area) other than a printing (recording) area, or adheres to the recording head.

SUMMARY

An advantage of some aspects of the invention is to solve at least some of the above-described problems and the invention can be realized by the following embodiments and application examples.

APPLICATION EXAMPLE 1

A recording apparatus according to the present application example is provided with a droplet discharging head including a nozzle forming portion, the nozzle forming portion including nozzles capable of discharging droplets onto a medium, the nozzles being formed in the nozzle forming portion, and a charging unit configured to impart an electrical charge to the medium. The charging unit imparts, to the medium, an electrical charge having the same polarity as an electrically charged state of the nozzle forming portion after the droplets are discharged.

In the recording apparatus, from a state in which the nozzle forming portion and a liquid are in contact with each other, when the liquid is discharged as the droplets and the nozzle forming portion and the droplets transit to a separated state, the nozzle forming portion and the droplets may be charged with a different polarity from each other.

Here, when the droplets electrically charged with a certain polarity adhere to the medium, the electrical charge of the polarity with which the droplets are charged accumulates on the medium. Then, when the electrically charged state of the polarity with which the droplets are charged becomes strong on the medium, if the polarity of the electrical charge of ink mist generated as a result of the discharge of the droplets is the same polarity as the electrical charge of the droplets, the ink mist is repelled by the droplets (liquid) on the medium, and the ink mist may adhere to an area other than a printing (recording) area, or may adhere to the nozzle forming portion that has the opposite polarity to the polarity of the electrical charge of the ink mist.

Here, according to the present configuration, an electrical charge having the same polarity as the electrically charged state of the nozzle forming portion after the droplets are discharged from the droplet discharging head is imparted to the medium. Specifically, the electrical charge of the opposite polarity to that of the droplets and the ink mist is imparted to the medium.

In this way, a change in the electrically charged state of the medium resulting from an increase in an amount of the droplets (liquid) adhering to the medium is suppressed. In other words, an accumulating of the electrical charge of the polarity of the droplets (liquid) is suppressed. In this way, the adherence of the ink mist to the area other than the printing (recording) area of the medium can be suppressed. Further, the adherence of the ink mist to the nozzle forming portion can be suppressed.

APPLICATION EXAMPLE 2

The charging unit of the recording apparatus according to the above-described application example imparts, to the medium, the electrical charge having the same polarity as the electrically charged state of the nozzle forming portion after the droplets are discharged, such that the medium before the droplets are discharged has the same polarity as the electrically charged state of the nozzle forming portion after the droplets are discharged.

According to this configuration, the accumulating of the electrical charge on the medium of the polarity of the droplets (liquid) can be efficiently suppressed.

APPLICATION EXAMPLE 3

The charging unit of the recording apparatus according to the above-described application examples imparts, to the medium before the droplets are discharged, the electrical charge having the same polarity as the electrically charged state of the nozzle forming portion after the droplets are discharged, such that, in the medium after the droplets are discharged, the electrical charge of a polarity opposite to the electrically charged state of the nozzle forming portion is not greater than a specific amount.

According to this configuration, before the droplets are discharged from the droplet discharging head, the electrical charge of the same polarity as the electrically charged state of the nozzle forming portion is imparted to the medium in advance, such that, in the medium, the electrical charge of the polarity opposite to the electrically charged state of the nozzle forming portion is not greater than the specific amount. Note that the electrical charge of the polarity opposite to the electrically charged state of the nozzle forming portion being not greater than the specific amount is, for example, an amount of the electrical charge at which the ink mist does not adhere to the nozzle forming portion. In this way, the amount of electrical charge imparted by the droplets can be offset in advance, and the ink mist can be suppressed from being repelled by the droplets (the liquid) on the medium. Thus, the ink mist can be caused to be more likely to adhere to the printing (recording) area of the medium, and the adherence of the ink mist to the nozzle forming portion can be suppressed.

APPLICATION EXAMPLE 4

The recording apparatus according to the above-described application examples includes a transport unit configured to transport the medium in a transport direction, and the charging unit is disposed further to an upstream side in the transport direction than the droplet discharging head.

According to this configuration, the electrical charge is imparted to the medium further to the upstream side in the transport direction of the medium than the droplet discharging head. In this way, the appropriate electrically charged state can be formed in the medium in advance, before the droplets are discharged onto the medium.

APPLICATION EXAMPLE 5

The recording apparatus according to the above-described application examples includes a scanning unit configured to cause the charging unit to scan, the charging unit being capable of imparting a desired electrical charge while being caused to scan by the scanning unit.

According to this configuration, the charging unit can impart the electrical charge to the medium while being caused to scan, and the configuration of the charging unit can be downsized.

APPLICATION EXAMPLE 6

A recording method according to the present application example includes droplet discharging for discharging droplets onto a medium from a nozzle forming portion including nozzles, the nozzles being formed in the nozzle forming portion, and electrical charge imparting for imparting an electrically charge to the medium. The electrical charge imparting includes imparting, to the medium, an electrical charge having the same polarity as an electrically charged state of the nozzle forming portion after the droplets are discharged.

In the recording method, from a state in which the nozzle forming portion and a liquid are in contact with each other, when the liquid is discharged as the droplets and the nozzle forming portion and the droplets transit to a separated state, the nozzle forming portion and the droplets are charged with a different polarity from each other.

Here, when the droplets electrically charged with a certain polarity adhere to the medium, the electrical charge of the polarity with which the droplets are charged accumulates on the medium. Then, when the electrically charged state of the polarity with which the droplets are charged becomes strong on the medium, if the polarity of the electrical charge of ink mist generated as a result of the discharge of the droplets is the same polarity as the electrical charge of the droplets, the ink mist is repelled by the droplets (liquid) on the medium, and the ink mist may adhere to an area other than a printing (recording) area, or may adhere to the nozzle forming portion that has the opposite polarity to the polarity of the electrical charge of the ink mist.

Here, according to the present configuration, the electrical charge having the same polarity as the electrically charged state of the nozzle forming portion after the droplets are discharged from the droplet discharging head is imparted to the medium. Specifically, the electrical charge of the opposite polarity to that of the droplets and the ink mist is imparted to the medium. In this way, a change in the electrically charged state of the medium resulting from an increase in an amount of the droplets (liquid) adhering to the medium is suppressed. In other words, an accumulating of the electrical charge of the polarity of the droplets (liquid) is suppressed.

In this way, the adherence of the ink mist to the area other than the printing (recording) area of the medium can be suppressed. Further, the adherence of the ink mist to the nozzle forming portion can be suppressed.

BRIEF DESCRIPTION OF THE DRAWINGS

The invention will be described with reference to the accompanying drawings, wherein like numbers reference like elements.

DESCRIPTION OF EMBODIMENTS

First to fourth exemplary embodiments of the invention will be described below with reference to the accompanying drawings. Note that, in each of the drawings below, to make each of members and the like a recognizable size, each of the members and the like are illustrated to be different from an actual scale.

First Exemplary Embodiment

First, a configuration of a recording apparatus will be described. The recording apparatus is, for example, an ink jet-type printer. In the present exemplary embodiment, a configuration of a large format printer (LFP), which handles relatively large media (a medium), will be described as an example of the recording apparatus.

Figure 1:
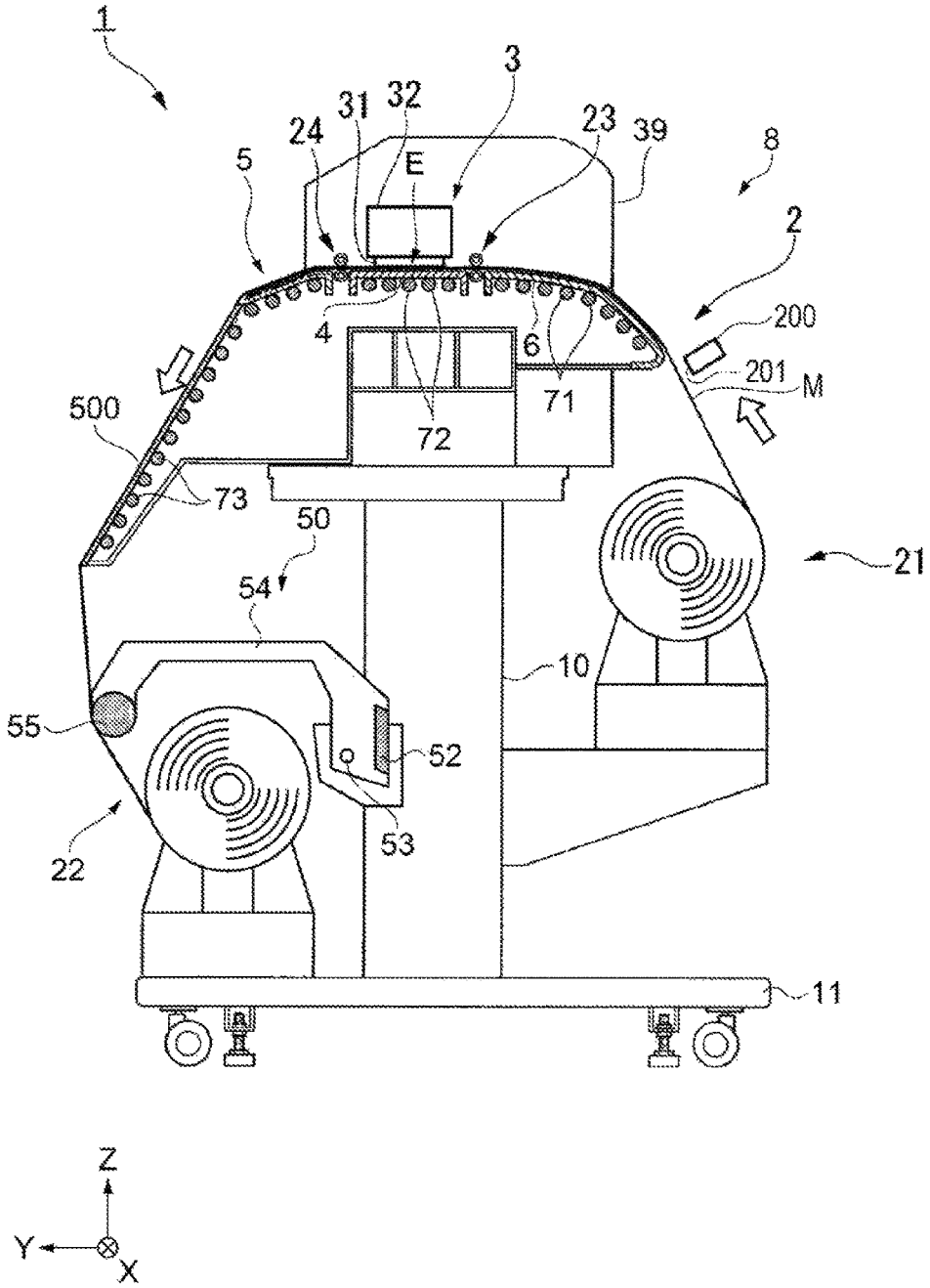
FIG. 1 is a schematic diagram illustrating a configuration of a recording apparatus according to a first exemplary embodiment.

FIG. 1 is a schematic diagram (part of which is a side cross-sectional diagram) illustrating the configuration of the recording apparatus. As illustrated in FIG. 1, a recording apparatus 1 is provided with a roll-to-roll type transport unit 2 that transports a medium M, a printing unit 3 that records (prints) images, characters, and the like by discharging (spraying), as droplets, ink that is an example of a liquid onto the medium M, a transport guide unit 5 on which is formed a transport surface that transports the medium M, and a platen 4 disposed in a position facing the printing unit 3. The recording apparatus 1 is further provide with a tension adjustment unit 50, which can impart tension to the medium M by coming into contact with the medium M. The recording apparatus 1 is further provided with a charging unit 200, which imparts an electrical charge to the medium M. Further, the recording apparatus 1 is provided with a control unit 100 (see FIG. 3), which controls the transport unit 2, the printing unit 3, the charging unit 200, and the like. Then, each of these structural elements is supported on a main body frame 10 that is disposed substantially vertically. Further, the main body frame 10 is connected to a base unit 11 that supports the main body frame 10.

The transport unit 2 transports the medium M in a transport direction (the direction of outlined arrows in the drawings). The transport unit 2 of the exemplary embodiment has a roll unit 21 that feeds the roll-shaped medium M in the transport direction, and a roll unit (reel unit) 22 that can take up the medium M that has been fed out. The transport unit 2 has transport roller pairs 23 and 24 that transport the medium M along a transport path between the roll units 21 and 22.

The printing unit 3 has a droplet discharging head (ink jet head) 31 that can discharge ink, as droplets, onto the medium M, and a carriage 32 on which the droplet discharging head 31 is mounted and which reciprocates freely in the width direction (an x-axis direction) of the medium M. Further, the recording apparatus 1 has a frame 39, and the droplet discharging head 31 and the carriage 32 are disposed inside the frame 39.

Figure 2:
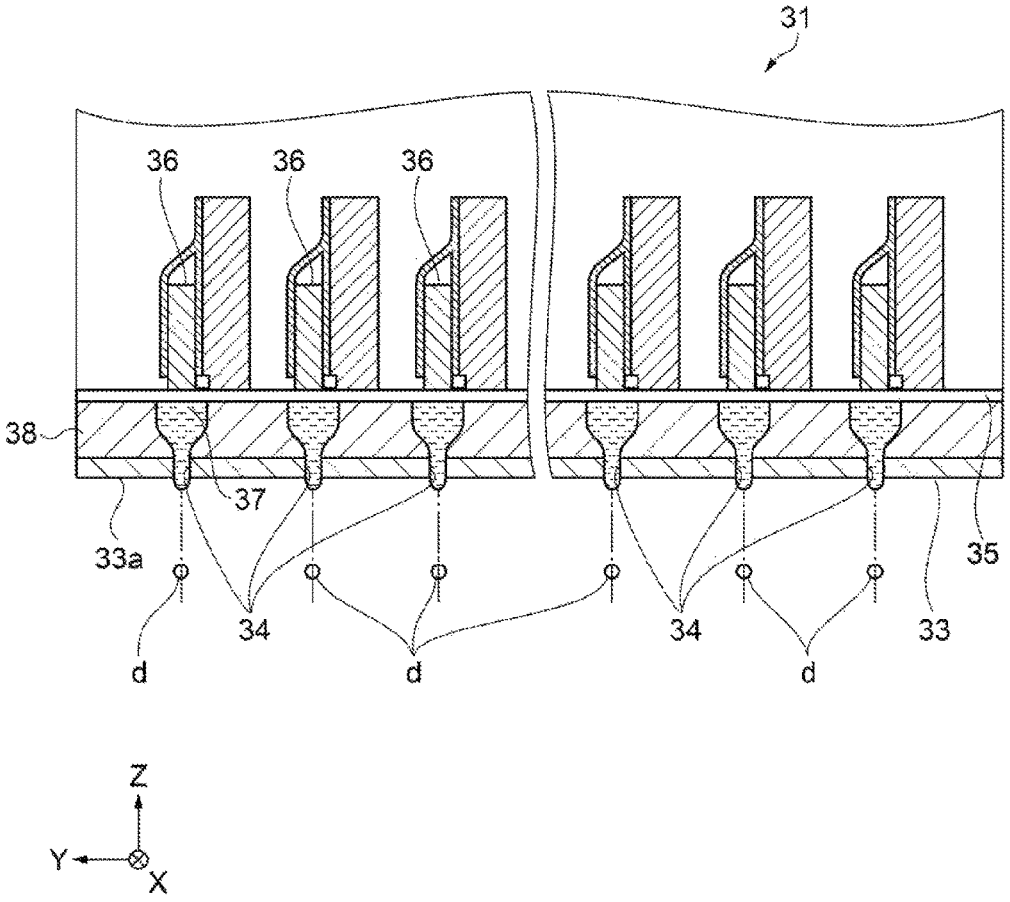
FIG. 2 is a cross-sectional diagram illustrating a configuration of a droplet discharging head according to the first exemplary embodiment.

FIG. 2 is a cross-sectional diagram illustrating a configuration of the droplet discharging head 31. As illustrated in FIG. 2, the droplet discharging head 31 has a nozzle forming portion 33 in which nozzles 34 are formed that can discharge droplets d onto the medium M. Cavities 37, which communicate with the nozzles 34, are formed in the upper side (a positive z-axis side) of the nozzle forming portion 33, in positions corresponding to the nozzles 34. The ink is supplied to the cavities 37 of the droplet discharging head 31. Note that, in the exemplary embodiment, a film deposition treatment (a liquid repellent treatment) using fluorine or the like is carried out on the surface of a surface 33*a*, which is on the opposite side to a surface connected to a cavity plate 38, in which the cavities 37 of the nozzle forming portion 33 are formed.

A vibration plate 35 and a piezoelectric element 36 are disposed on the upper side (the positive z-axis side) of the cavities 37. The vibration plate 35 vibrates vertically (in the positive and negative z-axis directions) and thus causes the capacity inside the cavities 37 to expand and contract. The piezoelectric element 36 expands and contracts in the vertical direction and causes the vibration plate 35 to vibrate. The piezoelectric element 36 expands and contracts in the vertical direction and causes the vibration plate 35 to vibrate, and the vibration plate 35 causes the capacity inside the cavities 37 to expand and contract. As a result, the cavities 37 are pressurized. In this way, the pressure inside the cavities 37 fluctuates, and the ink supplied into the cavities 37 passes through the nozzles 34 and is discharged as the droplets d.

Note that, in the exemplary embodiment, a pressurization unit using the vertical vibration-type piezoelectric element 36 is illustrated, but the invention is not limited to this example. For example, a flexural deformation-type piezoelectric element may be used that is formed by layering a lower electrode, a piezoelectric layer, and an upper electrode. Further, as a pressure generating unit, a so-called electrostatic actuator or the like may be used, in which static electricity is generated between the vibration plate and the electrodes and the vibration plate is caused to deform due to the static electricity, thus causing the droplets to be discharged from the nozzles. In addition, the droplet discharging head may be configured to discharge the ink as droplets using bubbles generated inside the nozzles using a heat generator.

Returning to FIG. 1, the platen 4 is disposed so as to be able to support the medium M over a discharge area E onto which the ink is discharged by the printing unit 3. Specifically, the recording apparatus 1 is provided with the platen 4 that can support the medium M over the discharge area E. In the exemplary embodiment, the platen 4 is disposed between the transport roller pairs 23 and 24.

The transport guide unit 5 has a guide portion 500 having the transport surface, and is disposed so as to be able to support the medium M further to the downstream side in the transport direction of the medium M than the platen 4. In the exemplary embodiment, as illustrated in FIG. 1, the transport guide unit 5 is provided between the transport roller pair 24 and the roll unit 22 on the transport path of the medium M. Further, the transport guide unit 5 is provided with heaters 73 that can heat the medium M. The heaters 73 of the exemplary embodiment are disposed on the side of a surface (back surface) on the opposite side to the surface of the transport guide unit 5 supporting the medium M. The heaters 37 are, for example, tube heaters, and are attached to the back surface of the transport guide unit 5 using aluminum tape or the like. Then, by using the heaters 73, the guide portion 500 supporting the medium M in the transport guide unit 5 is heated by thermal conduction, and the medium M can be heated from the reverse side of the medium M. Note that the platen 4 is also provided in a similar manner with heaters 72, on the side of a surface (back surface) on the opposite side to the surface of the platen 4 supporting the medium M. The configuration of the heaters 72 is the same as the configuration of the heaters 73.

Further, in the exemplary embodiment, an upstream side guide portion 6 is disposed so as to be able to support the medium M further to the upstream side in the transport direction of the medium M than the platen 4. The upstream side guide portion 6 is disposed between the roll unit 21 and the transport roller pair 23 on the transport path of the medium M. The upstream side guide portion 6 is also provided in a similar manner with heaters 71, on the side of a surface (back surface) on the opposite side to the surface of the upstream side guide portion 6 supporting the medium M. Note that the configuration of the heaters 71 is the same as the configuration of the heaters 73.

Here, the heaters 71 corresponding to the upstream side guide portion 6 are heaters for preheating the medium M further to the upstream side in the transport direction than a position at which the printing unit 3 is provided. The heaters 71 are configured to promote rapid drying of the ink from a time of impact by gradually heating the medium M from a normal temperature to a target temperature (a temperature of the heaters 72). The heaters 72 corresponding to the platen 4 are heaters for heating the medium M over the discharge area E of the printing unit 3. The heaters 72 are configured to cause the medium M to receive the impact of the ink in a state in which the target temperature is maintained, promote the rapid drying from the time of ink impact and cause the ink to dry rapidly on the medium M, thus preventing bleeding and blurring, and enhancing image quality. Then, the heaters 73 corresponding to the transport guide unit 5 raise the temperature of the mediumM to a temperature higher than the temperature rise caused by the heaters 71 and the heaters 72, and rapidly dries the ink that has not yet dried, of the ink impacted on the medium M. In this way, the recording apparatus 1 has a configuration in which the ink impacted on the medium M is caused to dry and be fixed on the medium M in a favorable manner, at least before being taken up by the roll unit 22. Note that temperature settings and the like of the heaters 71, 72, and 73 can be set as appropriate in accordance with the medium M, the ink, and printing conditions.

The tension adjustment unit 50 can impart tension to the medium M. The tension adjustment unit 50 of the exemplary embodiment is disposed so as to be able to impart the tension to the mediumM between the transport guide unit 5 and the roll unit 22. The tension adjustment unit 50 is provided with a pair of frame portions 54, and is configured to be able to rotate around a rotation shaft 53. Further, a tension bar 55 is disposed between the ends of the pair of frame portions 54. The tension bar 55 is formed to be longer in the width direction (the x-axis direction) than a width dimension of the largest medium M that can be handled by the recording apparatus 1. Then, the tension bar 55 is configured such that part of the tension bar 55 comes into contact with the medium M and imparts the tension to the medium M. Meanwhile, weight portions 52 are disposed on other ends of the pair of frame portions 54. In this way, by the tension adjustment unit 50 rotating around the rotation shaft 53, the position of the tension adjustment unit 50 can be displaced.

The charging unit 200 imparts an electrical charge to the medium M, and the electrical charge having the same polarity as the electrically charged state of the nozzle forming portion 33 after the droplets d are discharged. More specifically, the charging unit 200 imparts, to the medium M, the electrical charge having the same polarity as the electrically charged state of the surface of the nozzle forming portion 33 after the droplets d are discharged. Note that with respect to the surfaces of the nozzle forming portion 33, if the surface 33*a* of the nozzle forming portion 33 has been subjected to the film deposition treatment, for example, it is referred to as the coated surface 33*a*. Further, the electrically charged state refers to a state in which a body has an electrical charge, and is negatively charged when it has a negative electrical charge and is positively charged when it has a positive electrical charge. The electrically charged state can be detected, for example, using a surface potential meter or the like. In this way, it is possible to easily detect whether the electrically charged state of the surface of the nozzle forming portion 33 is the negatively charged state, or is the positively charged state.

Then, for example, when the electrically charged state of the surface of the nozzle forming portion 33 after the droplets dare discharged is the negatively charged state, a negative electrical charge is imparted to the medium M. As a method for imparting the negative electrical charge, for example, a negative ionizer that generates negative ions from an electrode is used and anions are emitted toward the mediumM from an emission portion 201 provided in a position facing the medium M. The anions are ions having a negative electrical charge. In this way, the negative electrical charge can be imparted to the medium M. Further, a length of the emission portion 201 of the charging unit 200 in a direction intersecting the transport direction of the medium M has the same dimension as the width dimension of the largest medium M that can be handled by the recording apparatus 1. In this way, the electrical charge can easily be imparted to the whole of the medium M in the width dimension direction.

Meanwhile, when the electrically charged state of the surface of the nozzle forming portion 33 after the droplets d are discharged is the positively charged state, a positive electrical charge is imparted to the medium M. As a means for imparting the positive electrical charge, for example, a positive ionizer that generates positive ions from an electrode is used and cations are emitted toward the medium M from the emission portion 201 provided in the position facing the medium M. The cations are ions having a positive electrical charge. In this way, the positive electrical charge can be imparted to the medium M.

Note that the charging unit 200 maybe provided with a negative ion generating portion (the negative ionizer) that generates the negative ions, a positive ion generating portion (the positive ionizer) that generates the positive ions, and a switching portion, and have a configuration in which the switching portion generates ions having the electrical charge of one of the polarities of either the anions (the negative ions) or the cations (the positive ions), and the electrical charge is imparted to the medium M. In addition, the charging unit 200 may be configured to spray the generated ions onto the medium M using a fan or the like, or may be configured to impart the ions (the electrical charge) to the medium M in a windless state without using the fan or the like. Further, a distance between the emission portion 201 of the charging unit 200 and the medium M (a distance between an electrode and the medium M, for example) can be set as appropriate while taking into account conditions for imparting the electrical charge to the medium M and the like.

In addition, the charging unit 200 is disposed further to the upstream side in the transport direction than the droplet discharging head 31. In the exemplary embodiment, the charging unit 200 is located further to the upstream side in the transport direction than the frame 39, and is disposed between the frame 39 and the roll unit 21. In this way, the electrical charge can be imparted to the medium M before the droplets d are applied to the medium M.

Figure 3:
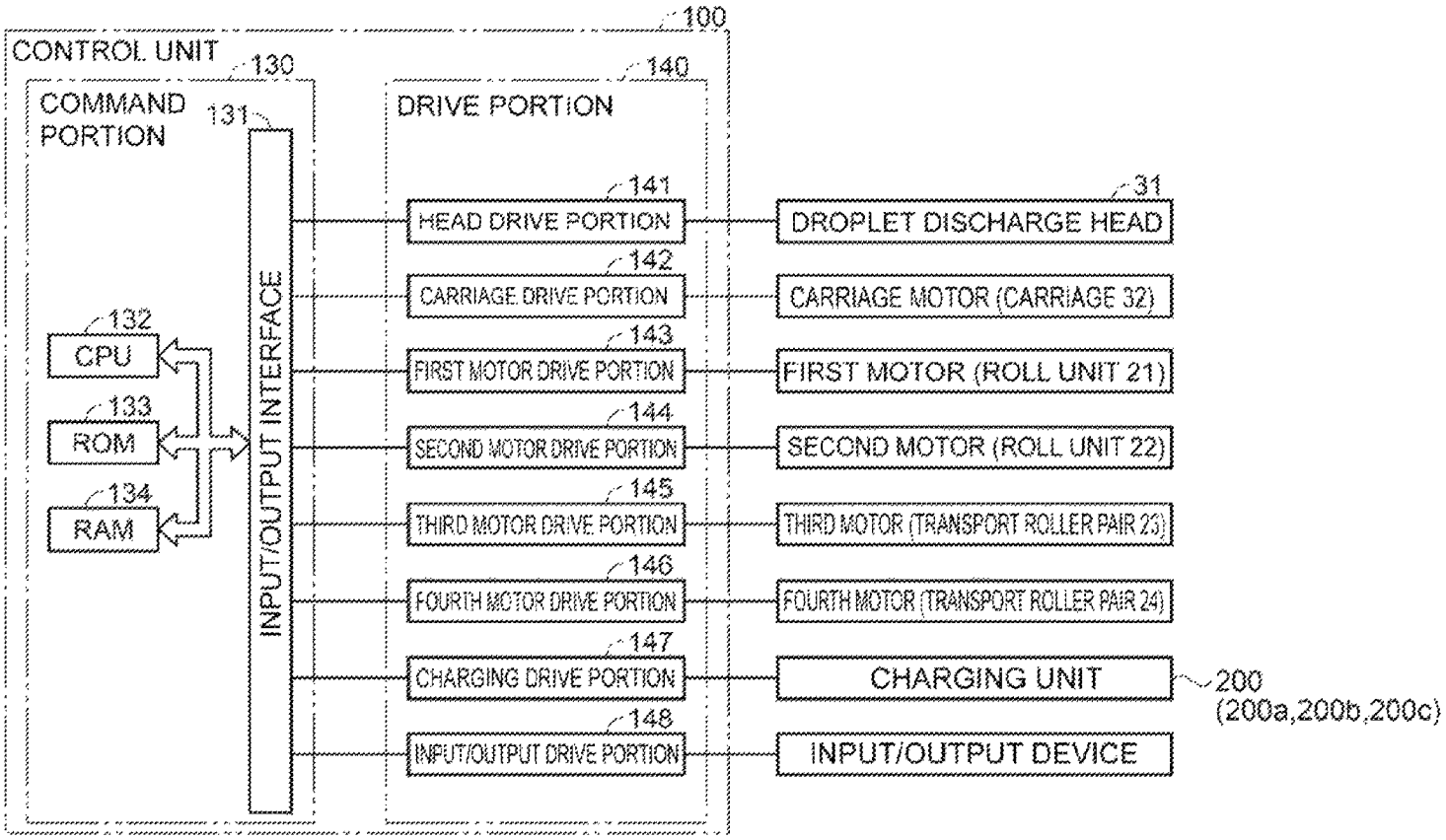
FIG. 3 is a block diagram illustrating a configuration of a control unit of the recording apparatus according to the first exemplary embodiment.

Next, a configuration of the control unit 100 of the recording apparatus 1 will be described. FIG. 3 is a block diagram illustrating the configuration of the control unit 100 of the recording apparatus 1. As illustrated in FIG. 3, the control unit 100 is provided with a command portion 130 and a drive portion 140. The command portion 130 is configured by a CPU 132, a ROM 133 and a RAM 134 that function as a storage unit, and an input/output interface 131. The CPU 132 processes various signals input via the input/output interface 132 on the basis of data stored in the ROM 133 and the RAM 134, and outputs control signals to the drive portion 140 via the input/output interface 131. The CPU 132 performs various controls on the basis of a drive program stored in the ROM 133, for example.

The drive portion 140 is configured by a head drive portion 141, a carriage drive portion 142, a first motor drive portion 143, a second motor drive portion 144, a third motor drive portion 145, a fourth motor drive portion 146, a charging drive portion 147, an input/output drive portion 148, and the like. The head drive portion 141 controls the droplet discharging head 31 on the basis of the control signals from the command portion 130. Further, the carriage drive portion 142 controls a carriage motor and controls the movement of the carriage 32. The first motor drive portion 143 controls the driving of a first motor of the roll unit 21. The second motor drive portion 144 controls the driving of a second motor of the roll unit 22. The third motor drive portion 145 controls the driving of a third motor connected to the transport roller pair 23. The fourth motor drive portion 146 controls the driving of a fourth motor connected to the transport roller pair 24. The charging drive portion 147 controls the charging unit 200. The input/output drive portion 148 controls an input/output device (not illustrated). Note that the input/output device is, for example, a touch panel, and has keys (buttons) for an input operation from a user, and is also a device that displays various information (such as a liquid crystal display). Note that the input/output device may have a configuration in which an input portion and an output portion are separately configured and controlled.

Then, in the recording apparatus 1, on the basis of drive signals of the control unit 100, the charging unit 200 imparts, to the medium M, the electrical charge having the same polarity as the electrically charged state of the nozzle forming portion 33 after the droplets d are discharged. More specifically, the charging unit 200 imparts, to the medium M the droplets dare discharged, the electrical charge having the same polarity as the electrically charged state of the nozzle forming portion 33 after the droplets d are discharged, such that the medium M before the droplets d are discharged has the same polarity as the electrically charged state of the nozzle forming portion 33 after the droplets d are discharged.

Here, in the droplet discharging head 31 of the recording apparatus 1, when the droplets d are discharged from the nozzles 34 from the state in which the nozzles 34 and the ink are in contact, the nozzle forming portion 33 and the droplets d are in the electrically charged state having different polarities from each other. Then, for example, when the electrically charged state of the surface of the nozzle forming portion 33 is the negatively charged state, and the electrically charged state of the droplets d is the positively charged state, as the droplets d adhere to the mediumM, the positive electrical charge accumulates in the medium M and the electrically charged state of the area to which the droplets d are adhered on the medium M becomes a more positively charged state. Then, when the positively charged state becomes strong on the mediumM, if the electrically charged state of the ink mist generated by the discharge of the droplets d is the positively charged state, which is the electrically charged state with the same polarity as the droplets d, the ink mist is repelled by the droplets d adhered to the medium M and, for example, the ink mist may adhere to an area other than the printing (recording) area of the medium M, or adhere to the nozzle forming portion 33 that has the opposite polarity to the polarity of the electrical charge of the ink mist.

Here, the charging unit 200 imparts, to the medium M, the negative electrical charge that is the same polarity as the electrically charged state of the nozzle forming portion 33 after the droplets d are discharged. In this way, the accumulating of the positive electrical charge of the medium M caused by the adherence of the droplets d is suppressed. Thus, this can suppress the ink mist from being repelled by the droplets d (the liquid) on the medium M, and cause the ink mist to be more likely to adhere to the printing (recording) area of the medium M. Further, the adherence of the ink mist to the nozzle forming portion 33 can be suppressed.

Further, in the recording apparatus 1, on the basis of the drive signals of the control unit 100, the charging unit 200 imparts, to the medium M before the droplets d are discharged, the electrical charge having the same polarity as the electrically charged state of the nozzle forming portion 33 after the droplets d are discharged, such that, in the medium M after the droplets d are discharged, the electrical charge of the polarity opposite to that of the electrically charged state of the nozzle forming portion 33 is not greater than a specific amount.

Specifically, as described above, as the droplets d adhere to the medium M, the positive electrical charge accumulates in the medium M, and when the amount of the positive electrical charge in the medium M exceeds a threshold, it is conceivable that the ink mist charged with the same polarity as the polarity of the electrical charge on the medium M side is repelled by the surface (the area to which the droplets d are adhered) of the medium M, and adheres to the area (the margin area, for example) other than the printing (recording) area of the medium M, or adheres to the nozzle forming portion 33 that has the different polarity to the ink mist. Here, the amount of the electrical charge of the medium M is set to the specific amount, which is a level at which the ink mist does not adhere to the area (the margin area, for example) other than the printing (recording) area of the medium M, and does not adhere to the nozzle forming portion 33, and the negative electrical charge is imparted to the medium M before the droplets d are discharged onto the medium M, such that the amount of the electrical charge is not greater than the specific amount. Note that the specific amount of the electrical charge of the medium M can be set, for example, as the electric potential of the surface of the medium M.

Here, the electric potential set as the specific amount is obtained in advance by evaluation or the like, before the droplets d are discharged. Then, on the basis of the electric potential obtained in advance, the charging unit 200 imparts, to the medium M, the electrical charge having the same polarity as the electrically charged state of the nozzle forming portion 33 after the droplets d are discharged, such that the electrical potential of the surface is not greater than the electric potential. In this way, the ink mist can be attracted to the medium M, and caused to be more likely to adhere to the printing (recording) area of the medium M, and the adherence to the nozzle forming portion 33 can be suppressed.

Note that, since the specific amount of the electrical charge in the medium M having the polarity opposite to the electrically charged state of the nozzle forming portion 33 also changes depending on a discharge rate of the droplets d onto the medium M, the specific amount may be set each time in accordance with the discharge rate of the droplets d, and the charging unit 200 may be driven and controlled under conditions satisfying the requirement of not exceeding the specific amount. Alternatively, the specific amount may be set for a maximum discharge rate of the droplets d onto the medium M and the charging unit 200 may be driven and controlled.

Further, the specific amount of the electrical charge of the medium M having the polarity opposite to the electrically charged state of the nozzle forming portion 33 changes depending on the surface shape of the nozzle forming portion 33 of the droplet discharging head 31 and on the type of ink, and also changes depending on the form of the medium M and the form of the transport unit 2 and the like. Thus, the specific amount is preferably set as required.

In addition, a surface potential measuring portion may be provided that measures the electric potential of the surface of the medium M to which the electrical charge has been imparted by the charging unit 200. If this configuration is adopted, the electric potential of the surface of the medium M (the electrically charged state of the medium M) can be easily managed.

Figure 4:
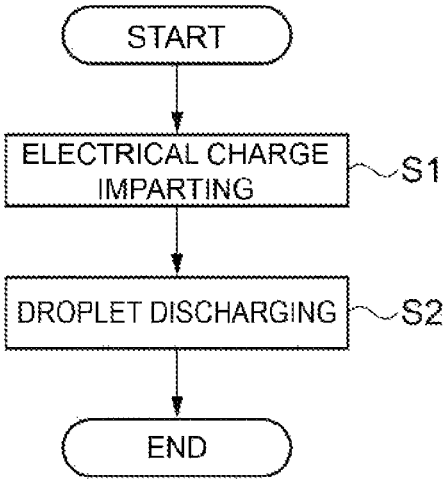
FIG. 4 is a flowchart illustrating a recording method according to the first exemplary embodiment.

Next, a recording method will be described. FIG. 4 is a flowchart illustrating the recording method. The recording method of the exemplary embodiment includes a droplet discharging in which the droplets d are discharged onto the medium M from the nozzle forming portion 33 including the nozzles 34, the nozzles 34 being formed in the nozzle forming portion 33, and an electrical charge imparting in which the electrical charge is imparted to the medium M. This will be described in detail below. Note that, in the recording method of the exemplary embodiment, the description will be made of a case in which, in the above-described recording apparatus 1 (see FIG. 1 to FIG. 3), when the droplets d are discharged, the nozzle forming portion 33 is negatively charged.

First, at step S1 of the electrical charge imparting, the electrical charge having the same polarity as the electrically charged state of the nozzle forming portion 33 after the droplets d are discharged is imparted to the medium M. Specifically, the charging unit 200 is used to impart, to the medium M, the electrical charge (the negative electrical charge) of the same polarity as the electrically charged state of the nozzle forming portion 33 after the droplets d are discharged, such that the medium M before the droplets d are discharged has the same polarity as the electrically charged state (the negative electrical charge) of the nozzle forming portion 33 after the droplets d are discharged. More specifically, the anions are generated by the charging unit 200 and the generated anions are emitted from the emission portion 201, thus imparting the anions to the surface of the medium M.

At that time, the electrical charge (the negative electrical charge) of the same polarity as the electrically charged state (the negative electrical charge) of the nozzle forming portion 33 after the droplets d are discharged is imparted to the medium M before the droplets d are discharged, such that, in the medium M after the droplets d are discharged, the electrical charge (the positive electrical charge) opposite to the polarity of the electrically charged state (the negative electrical charge) of the nozzle forming portion 33 is not greater than the specific amount. Whether or not the electrical charge (the positive electrical charge) is not greater than the specific amount is determined, for example, by measuring the electric potential of the medium M using a surface potential meter.

Next, in the droplet discharging at step S2, the droplets d are discharged from the droplet discharging head 31, which is disposed on the downstream side of the charging unit 200 in the transport direction, and the discharged droplets d are caused to adhere to the medium M.

Here, when the electrically charged state of the surface of the nozzle forming portion 33 is the negatively charged state, and the electrically charged state of the droplets d is the positively charged state, as the droplets d adhere to the medium M, the positive electrical charge accumulates in the medium M and the electrically charged state of the area on which the droplets d adhere to the medium M becomes a more positively charged state. As a result, the ink mist may adhere to the area (the margin area, for example) other than the printing (recording) area of the medium M, or adhere to the nozzle forming portion 33 that has the electrical charge polarity opposite to the electrical charge polarity of the ink mist. However, before the discharge of the droplets d, the negative electrical charge is imparted in advance to the medium M with the same polarity as the electrically charged state (the negative electrical charge) of the nozzle forming portion 33 after the droplets d are discharged. Specifically, since the negative electrical charge with the opposite polarity to the electrically charged state (the positive electrical charge) of the discharged droplets d is imparted to the medium M, the accumulating of the positive electrical charge in the medium M is suppressed. Thus, this can suppress the ink mist from being repelled by the droplets d (the liquid) on the medium M, and cause the ink mist to be more likely to adhere to the printing (recording) area of the medium M. Further, the adherence of the ink mist to the nozzle forming portion 33 can be suppressed.

According to the exemplary embodiment, as described above, the following effects can be obtained.

Before the droplets dare discharged onto the medium M, the charging unit 200 imparts, to the medium M, the electrical charge having the same polarity as the electrically charged state of the nozzle forming portion 33 after the droplets d are discharged. This can suppress the change in the electrically charged state of the medium M resulting from the increase in the amount of droplets (liquid) adhered to the medium M. Then, this can suppress the ink mist from being repelled by the droplets d (the liquid) on the medium M, and cause the ink mist to be more likely to adhere to the printing (recording) area of the medium M, and suppress the adherence of the ink mist to the nozzle forming portion 33.

Second Exemplary Embodiment

Figure 5:
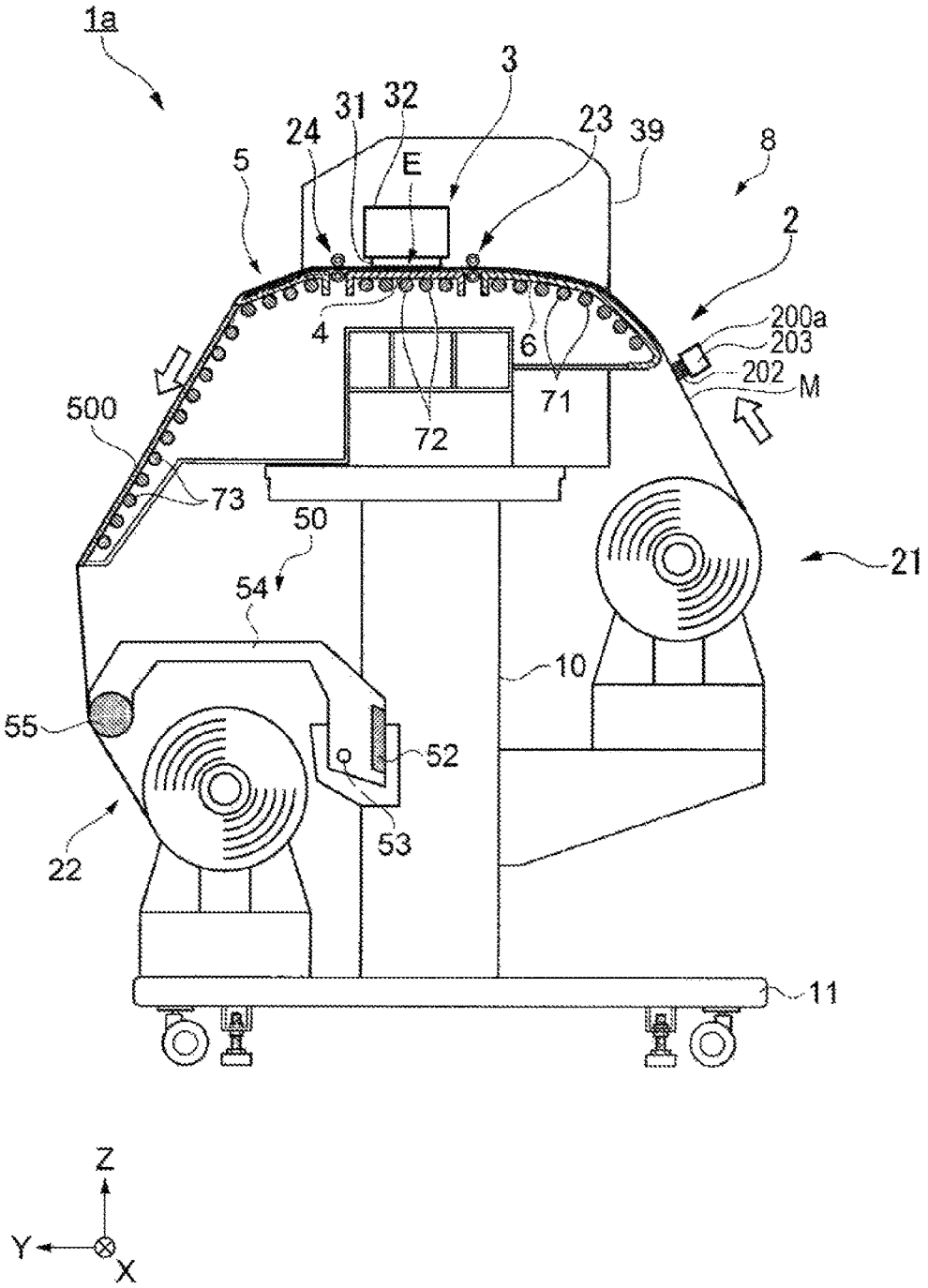
FIG. 5 is a schematic diagram illustrating a configuration of a recording apparatus according to a second exemplary embodiment.

Next, a second exemplary embodiment will be described. FIG. 5 is a schematic diagram illustrating a configuration of a recording apparatus according to the present exemplary embodiment. Note that the basic configuration of the recording apparatus according to the exemplary embodiment is substantially the same configuration as that according to the first exemplary embodiment, and a description thereof is omitted here. Below, units and portions differing from the first exemplary embodiment, specifically, the configuration of the charging unit, will be mainly described.

As illustrated in FIG. 5, a recording apparatus la is provided with the droplet discharging head 31, a charging unit 200*a*, and the like. The configuration of the droplet discharging head 31 is the same as that of the first exemplary embodiment and a description thereof is thus omitted here (see FIG. 1 to FIG. 3).

The charging unit 200*a* imparts, to the medium M, an electrical charge having the same polarity as the electrically charged state of the nozzle forming portion 33 after the droplets d are discharged. The charging unit 200*a* is provided with a brush portion 202 formed of electroconductive chemical fibers, metal fibers, and the like, a holding portion 203 that holds the brush portion 202, and a power supply portion (not illustrated) that supplies a negative electrical charge or a positive electrical charge to the brush portion 202. Note that the electrically charged state of the nozzle forming portion 33 can be determined, for example, using a surface potential meter or the like.

The charging unit 200*a* is disposed further to the upstream side in the transport direction than the droplet discharging head 31. In the exemplary embodiment, the charging unit 200*a* is located further to the upstream side in the transport direction than the frame 39, and is disposed between the frame 39 and the roll unit 21. Further, a length of the brush portion 202 in a direction intersecting the transport direction of the medium M has the same dimension as the width dimension of the largest medium M that can be handled by the recording apparatus 1*a*. In this way, the electrical charge can easily be imparted to the whole surface of the medium M before the droplets d are discharged onto the medium M. Further, a distal end of the brush portion 202 is configured so as to be able to come into contact with the surface of the medium M. Note that the charging unit 200*a* may be disposed such that the distal end of the brush portion 202 and the surface of the medium M are in contact with each other, or the charging unit 202*a* may be disposed such that a gap is provided between the distal end of the brush portion 202 and the surface of the medium M (in a non-contact state).

Then, for example, when the electrically charged state of the surface of the nozzle forming portion 33 after the droplets dare discharged is the negatively charged state, a negative electrical charge is imparted to the medium M from the brush portion 202, by the negative electrical charge being supplied to the brush portion 202 from the power supply portion. On the other hand, when the electrically charged state of the surface of the nozzle forming portion 33 after the droplets dare discharged is the positively charged state, a positive electrical charge is imparted to the medium M from the brush portion 202, by the positive electrical charge being supplied to the brush portion 202 from the power supply portion.

Further, in the recording apparatus 1*a*, the charging unit 200*a* imparts, to the medium M before the droplets d are discharged, the electrical charge having the same polarity as the electrically charged state of the nozzle forming portion 33 after the droplets d are discharged, such that, in the medium M after the droplets d are discharged, the electrical charge of the polarity opposite to that of the electrically charged state of the nozzle forming portion 33 is not greater than a specific amount. Here, the electrical charge of the polarity opposite to the electrically charged state of the nozzle forming portion 33 being not greater than the specific amount refers to an amount of the electrical charge at which the ink mist does not adhere to the area (the margin area, for example) other than the printing (recording) area of the medium M, and does not adhere to the nozzle forming portion 33. Then, the amount of electrical charge is set as the specific amount and the negative electrical charge or the positive electrical charge is imparted to the medium M before the droplets d are discharged onto the medium M. Note that the specific amount of the electrical charge of the medium M can be set, for example, as the electric potential of the surface of the medium M.

According to the exemplary embodiment, as described above, the following effects can be obtained.

The electrical charge having the same polarity as the electrically charged state of the nozzle forming portion 33 after the droplets d are discharged is imparted to the medium M by the charging unit 200*a*. In this way, the accumulating of the electrical charge of the medium M caused by the electrical charge of the droplets d is suppressed. Thus, the ink mist can be attracted to the medium M side, and caused to be more likely to adhere to the printing (recording) area of the medium M. Further, the adherence of the ink mist to the nozzle forming portion 33 can be suppressed.

Third Exemplary Embodiment

Figure 6:
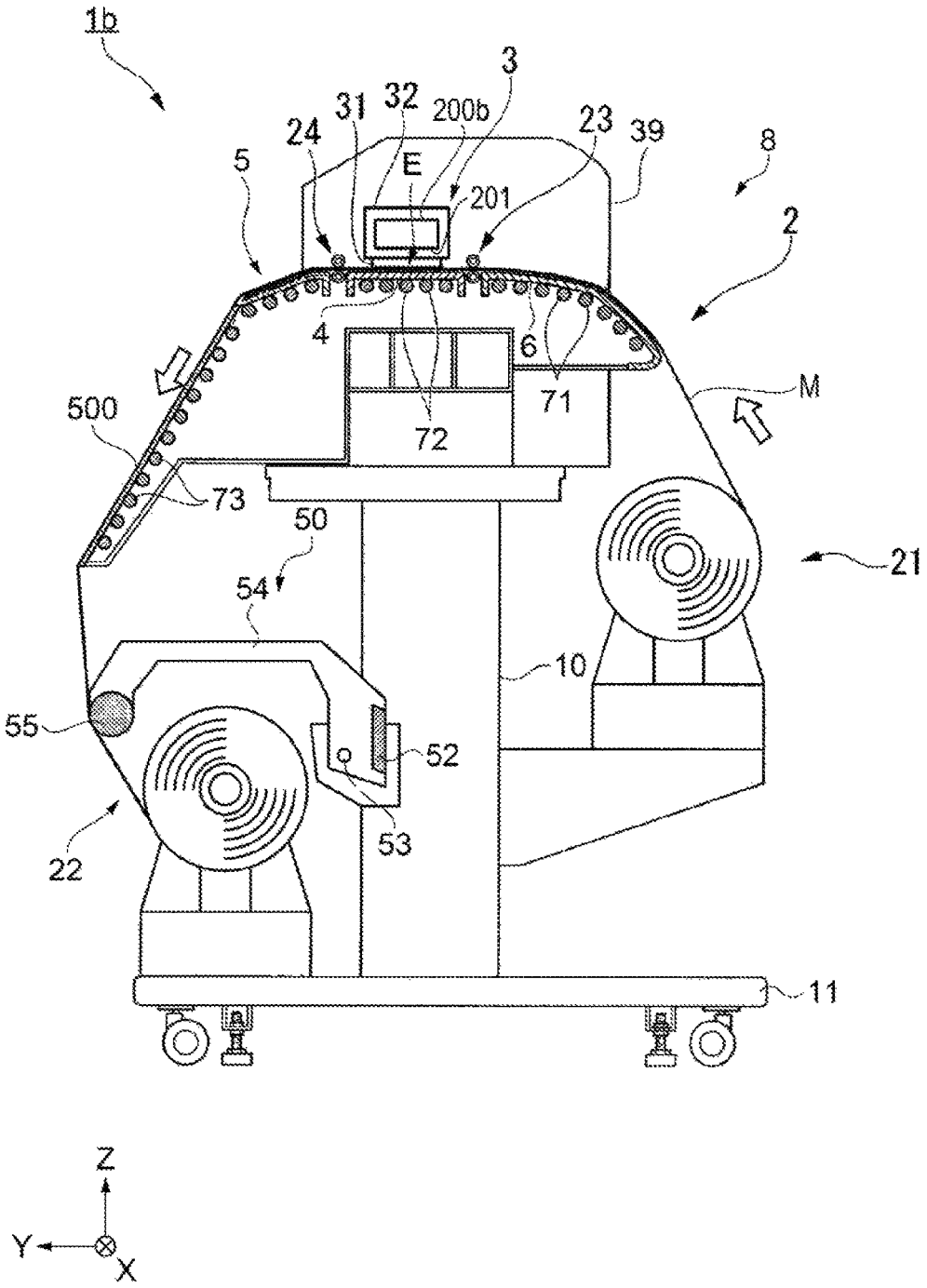
FIG. 6 is a schematic diagram illustrating a configuration of a recording apparatus according to a third exemplary embodiment.
Figure 7:
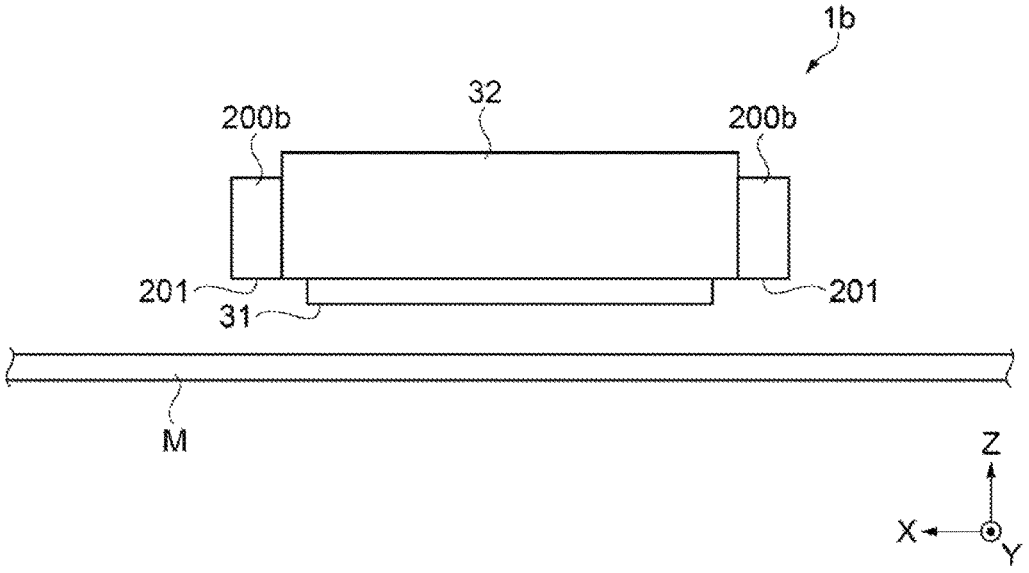
FIG. 7 is a schematic diagram illustrating a configuration of a charging unit according to the third exemplary embodiment.

Next, a third exemplary embodiment will be described. FIG. 6 is a schematic diagram illustrating a configuration of a recording apparatus according to the present exemplary embodiment, and FIG. 7 is a schematic diagram illustrating a configuration of a charging unit. Note that the basic configuration of the recording apparatus according to the exemplary embodiment is substantially the same configuration as that according to the first exemplary embodiment, and a description thereof is omitted here. Below, units and portions differing from the first exemplary embodiment, specifically, the configuration of the charging unit, will be mainly described.

As illustrated in FIG. 6, a recording apparatus 1*b* is provided with the droplet discharging head 31, charging units 200*b*, a scanning unit, and the like. Note that the configuration of the droplet discharging head 31 is the same as that of the first exemplary embodiment and a description thereof is thus omitted here (see FIG. 1 to FIG. 3).

The charging units 200*b* impart, to the medium M, an electrical charge having the same polarity as the electrically charged state of the nozzle forming portion 33 after the droplets d are discharged. The charging units 200*b* of the exemplary embodiment are disposed on the carriage 32, which is the scanning unit. Thus, in the exemplary embodiment, the charging units 200*b* are configured to be disposed inside the frame 39. Note that the basic configuration of the charging unit 200*b* is the same as the configuration of the charging unit 200 (the negative ionizer or the positive ionizer) according to the first exemplary embodiment and a description thereof is thus omitted here.

The scanning unit causes the charging unit 200*b* to scan. In the exemplary embodiment, a configuration is adopted in which the carriage 32 is the scanning unit and causes the charging units 200*b* to scan, and the charging units 200*b* can impart a desired electrical charge while the carriage 32 is scanning. Specifically, as illustrated in FIG. 7, the charging units 200*b* are disposed on end portions of the carriage 32 in a scanning direction (the x-axis direction) of the carriage 32. In the exemplary embodiment, the charging units 200*b* are disposed on both end portions of the carriage 32 in the scanning direction (the x-axis direction) of the carriage 32, respectively. In this way, by causing the carriage 32 to scan (to move), the charging units 200*b* can be caused to scan (to move). Further, a dimension in the y-axis direction of the emission portion 201 of the charging unit 200*b* is substantially the same as a dimension of a nozzle array of the nozzles 34 formed in the y-axis direction of the droplet discharging head 31.

Then, for example, when the electrically charged state of the surface of the nozzle forming portion 33 after the droplets dare discharged is the negatively charged state, the negative electrical charge is imparted to the medium M while the carriage 32 is scanning and the droplets d are being discharged toward the medium M from the droplet discharging head 31. In this case, the charging units 200*b* (the negative ionizers) emit anions toward the mediumM from the emission portion 201 provided in a position facing the medium M. The anions are ions having a negative electrical charge. In this way, the negative electrical charge can be imparted to the medium M.

On the other hand, when the electrically charged state of the surface of the nozzle forming portion 33 after the droplets dare discharged is the positively charged state, the positive electrical charge is imparted to the medium M while the carriage 32 is scanning and the droplets d are being discharged toward the medium M from the droplet discharging head 31. In this case, the charging units 200*b* (the positive ionizers) emit cations toward the medium M from the emission portion 201 provided in a position facing the medium M. The cations are ions having a positive electrical charge. In this way, the positive electrical charge can be imparted to the medium M.

Note that, when the charging units 200*b* are driven while the carriage 32 is scanning, of the charging unit 200*b* on the upstream side in the movement direction of the carriage 32 (the droplet discharging head 31) and the charging unit 200*b* on the downstream side in the movement direction of the carriage 32 (the droplet discharging head 31), one of the charging units 200*b* may be driven, or both of the charging units 200*b* may be driven, and the electrical charge may be caused to be emitted from the emission portion 201. For example, when only the charging unit 200*b* on the upstream side in the movement direction of the carriage 32 (the droplet discharging head 31) is driven, the electrical charge is imparted to the medium M before the droplets d are discharged from the droplet discharging head 31. On the other hand, when only the charging unit 200*b* on the downstream side in the movement direction of the carriage (the droplet discharging head 31) is driven, the electrical charge is imparted to the medium M (including the applied droplets d) after the droplets d are discharged from the droplet discharging head 31. Further, when the charging units 200*b* on both the upstream side and the downstream side in the movement direction of the carriage 32 (droplet discharging head 31) are driven, the electrical charge is imparted to the medium M before the droplets d are discharged from the droplet discharging head 31 and after the droplets d are discharged from the droplet discharging head 31.

According to the exemplary embodiment, as described above, the following effects can be obtained.

Since the negative electrical charge is imparted to the medium M while the carriage 32 is scanning and the droplets d are being discharged onto the medium M from the droplet discharging head 31, the accumulating of the electrical charge with respect to the discharged droplets d is suppressed at each pass by the scanning of the droplet discharging head 31. Thus, the ink mist can be attracted to the medium M side, and caused to be more likely to adhere to the printing (recording) area of the medium M. Further, the adherence of the ink mist to the nozzle forming portion 33 can be suppressed. Further, the charging units 200*b* can impart the electrical charge to the medium M while being caused to scan, and this eliminates the need for the charging unit 200*b* to have a size matching the medium M. As a result, the configuration of the charging unit 200*b* can be downsized.

Fourth Exemplary Embodiment

Figure 8:
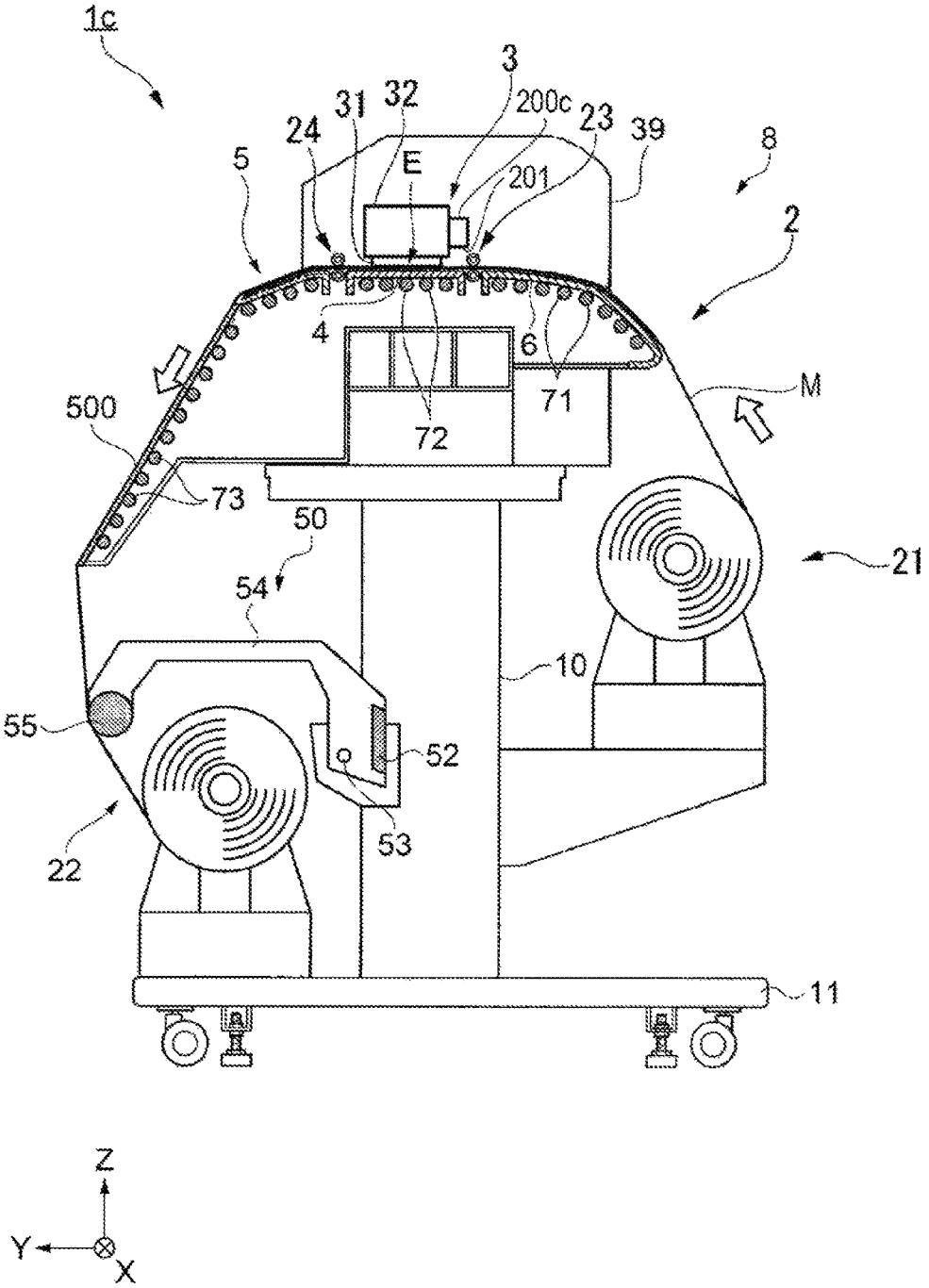
FIG. 8 is a schematic diagram illustrating a configuration of a recording apparatus according to a fourth exemplary embodiment.
Figure 9:
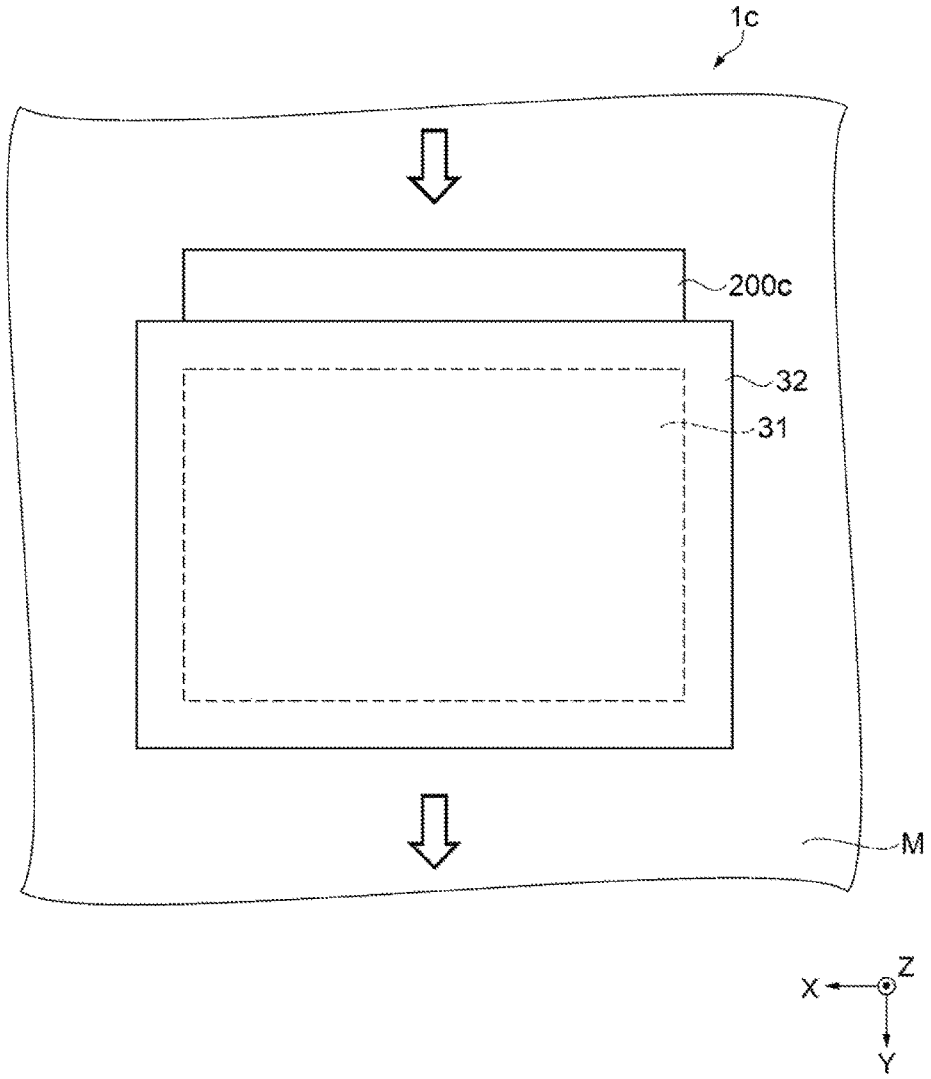
FIG. 9 is a schematic diagram illustrating a configuration of a charging unit according to the fourth exemplary embodiment.

Next, a fourth exemplary embodiment will be described. FIG. 8 is a schematic diagram illustrating a configuration of a recording apparatus according to the present exemplary embodiment, and FIG. 9 is a schematic diagram illustrating a charging unit. Note that the basic configuration of the recording apparatus according to the exemplary embodiment is substantially the same configuration as that according to the first exemplary embodiment, and a description thereof is omitted here. Below, units and portions differing from the first exemplary embodiment, specifically, the configuration of the charging unit, will be mainly described.

As illustrated in FIG. 8, a recording apparatus 1*c* is provided with the droplet discharging head 31, a charging unit 200*c*, the scanning unit, and the like. Note that the configuration of the droplet discharging head 31 is the same as that of the first exemplary embodiment and a description thereof is thus omitted here (see FIG. 1 to FIG. 3).

Before the droplet discharging head 31 discharges the droplets d, the charging unit 200*c* imparts, to the medium M, an electrical charge having the same polarity as the electrically charged state of the nozzle forming portion 33 after the droplets d are discharged. The charging unit 200*c* of the exemplary embodiment is disposed on the carriage 32, which is the scanning unit. Thus, in the exemplary embodiment, the charging unit 200*c* is configured to be disposed inside the frame 39. Note that the basic configuration of the charging unit 200*c* is the same as the configuration of the charging unit 200 (the negative ionizer or the positive ionizer) according to the first exemplary embodiment and a description thereof is thus omitted here.

The scanning unit causes the charging unit 200*c* to scan. In the exemplary embodiment, a configuration is adopted in which the carriage 32 is the scanning unit and causes the charging unit 200*c* to scan, and the charging unit 200*c* can impart the desired electrical charge while the carriage 32 is scanning. Specifically, as illustrated in FIG. 9, the charging unit 200*c* is disposed on the upstream end of the carriage 32 (the droplet discharging head 31) in the transport direction (outlined arrows in FIG. 9) of the medium M. In this way, by causing the carriage 32 to scan (to move), the charging unit 200*c* can be caused to scan (to move).

Then, for example, when the electrically charged state of the surface of the nozzle forming portion 33 after the droplets dare discharged is the negatively charged state, the negative electrical charge is imparted to the medium M while the carriage 32 is scanning and the droplets d are being discharged toward the medium M from the droplet discharging head 31. In this case, the charging unit 200*c* (the negative ionizer) emits anions toward the medium M from the emission portion 201 provided in a position facing the medium M. The anions are ions having a negative electrical charge. In this way, the negative electrical charge can be imparted to the medium M before the droplets d are discharged.

On the other hand, when the electrically charged state of the surface of the nozzle forming portion 33 after the droplets dare discharged is the positively charged state, the positive electrical charge is imparted to the medium M while the carriage 32 is scanning and the droplets d are being discharged toward the medium M from the droplet discharging head 31. In this case, the charging unit 200*c* (the positive ionizer) emits cations toward the medium M from the emission portion 201 provided in a position facing the medium M. The cations are ions having a positive electrical charge. In this way, the positive electrical charge can be imparted to the medium M before the droplets d are discharged.

According to the exemplary embodiment, as described above, the following effects can be obtained.

The electrical charge is imparted to the medium M further to the upstream side in the transport direction of the medium M than the droplet discharging head 31. In this way, the appropriate electrically charged state can be got in the medium M before the droplets d are discharged onto the medium M. Further, the charging unit 200*c* can impart the electrical charge to the medium M while being caused to scan, and this eliminates the need for the charging unit 200*c* to have a size matching the medium M. As a result, the configuration of the charging unit 200*c* can be downsized.

Note that the invention is not limited to the above-described exemplary embodiments, and various changes, modifications and the like can be added to the above-described exemplary embodiments. Modified examples will be described below.

MODIFIED EXAMPLE 1

In the first exemplary embodiment and the second exemplary embodiment, the emission portion 201 and the brush portion 202 of the charging units 200 and 200*a* have the same dimension in the width direction of the medium M intersecting the transport direction of the medium M, but the emission portion 201 and the brush portion 202 are not limited to this configuration. For example, a configuration may be adopted in which a scanning unit is provided in a direction intersecting the transport direction of the medium M that causes the charging units 200 and 200*a* to scan, and the electrical charge is imparted from the charging units 200 and 200*a* to the medium M while the charging units 200 are caused to scan by the scanning unit. This eliminates the need for the charging units 200 and 220*a* to have a size matching the medium M. As a result, the configuration of the charging units 200 and 200*a* can be downsized.

MODIFIED EXAMPLE 2

In the second exemplary embodiment, the brush portion 202 of the charging unit 200*a* is configured by the electroconductive chemical fibers, the metal fibers, and the like, but the brush portion 202 is not limited to these examples. For example, a cloth material may be used, or a roller member or the like may be adopted. In this case, an appropriate material may be selected while taking into account the electrically charged state of the medium M resulting from the contact between the charging unit 200*a* and the medium M. Even if this type of configuration is adopted, the same effects as those described above can be obtained.

MODIFIED EXAMPLE 3

In the first to fourth exemplary embodiments, the configuration is adopted in which the recording apparatus 1, 1*a*, 1*b*, and 1*c* are provided with the carriage 32 that can cause the droplet discharging head 31 to scan, but the configuration is not limited to this example. For example, a configuration may be adopted in which the droplets d can be discharged across the width direction of the medium M without causing the droplet discharging head 31 to scan. At this time, the droplet discharging head 31 is configured as a so-called line head in which a nozzle array is formed along the width direction of the medium M. Note that, in this case, the scanning unit according to the third and fourth exemplary embodiments need not necessarily be the carriage 32 and may be separately provided. Even if this type of configuration is adopted, the same effects as those described above can be obtained.

MODIFIED EXAMPLE 4

A configuration may be adopted in which the first to fourth exemplary embodiments and each of the modified examples are combined as appropriate. If such a configuration is adopted, the electrical charge having the same polarity as the electrically charged state of the nozzle forming portion 33 after the droplets d are discharged can be more efficiently imparted to the medium M.

MODIFIED EXAMPLE 5

As the recording apparatus 1, 1*a*, 1*b*, and 1*c*, a liquid discharging apparatus may be adopted that sprays and discharges a liquid other than the ink. For example, the invention can be applied to various types of recording apparatus provided with a droplet discharging head that discharges micro droplets, and the like. Note that "droplet" refers to the state of the liquid discharged from the above-described recording apparatus, and also includes granular-shaped droplets, tear-shaped droplets, and droplets leaving a thread-like trail. Further, the liquid referred to here may be a material that can be discharged (sprayed) by the liquid discharging apparatus. For example, it is sufficient that the material be in a liquid phase state, and the material does not only include a liquid-state body with high or low viscosity, a flowing state such as a sol, gel water, another inorganic solvent, an organic solvent, a solution, a liquid-state resin, a liquid-state metal (metallic melt), or a liquid as one state of a material, but also includes a material in which the particles of a functional material formed of solid matter, such as a pigment or metal particles, are dissolved, dispersed or mixed in a solvent, and the like. Further, the ink such as that described in the above-described exemplary embodiments can be given as a representative example of the liquid. Here, the "ink" includes general water-based ink and oil-based ink, along with various liquid composites, such as gel ink and hot melt ink. In addition, in addition to a plastic film, such as vinyl chloride film, the medium includes high performance paper stretched thinly as a result of heating, textiles such as cloth and woven fabric, and substrates or metal plates and the like.

This application claims priority under 35 U.S.C. § 119 to Japanese Patent Application No. 2016-102169, filed May 23, 2016. The entire disclosure of Japanese Patent Application No. 2016-102169 is hereby incorporated herein by reference.

What is claimed is:

1. A recording apparatus comprising:

a droplet discharging head configured to discharges droplets onto a medium from a nozzle forming portion including nozzles, the nozzles being formed in the nozzle forming portion, the droplets having a first polarity and the nozzle forming portion having a second polarity that is opposite of the first polarity; and a charging unit configured to provide an electrical charge to the medium, the provided electrical charge being generated by the charging unit, wherein the charging unit provides, to the medium, a specific amount of an electrical charge having the second polarity, wherein the specific amount of the electrical charge provided by the charging unit to the medium is determined by one of:

for each specific time that the droplets are discharged, a discharge rate of the droplets discharged onto the medium during the specific time, or a maximum discharge rate of the droplets discharged onto the medium.

2. The recording apparatus according to claim 1, wherein the charging unit provides, to the medium before the droplets are discharged, the electrical charge having the second polarity, such that, in the medium after the droplets are discharged, an electrical charge of the first polarity which is opposite to the second polarity is not greater than the specific amount.

3. The recording apparatus according to claim 2, further comprising:

a carriage unit that is configured to cause the charging unit to move, wherein the charging unit is capable of providing the electrical charge while being caused to move by the carriage unit.

4. The recording apparatus according to claim 2, further comprising:

a transport unit configured to transport the medium in a transport direction, wherein the charging unit is disposed further to an upstream side in the transport direction than the droplet discharging head.

5. The recording apparatus according to claim 4, further comprising:

a carriage unit that is configured to cause the charging unit to move, wherein the charging unit is capable of providing the electrical charge while being caused to move by the carriage unit.

6. The recording apparatus according to claim 1, further comprising:

a transport unit configured to transport the medium in a transport direction, wherein the charging unit is disposed further to an upstream side in the transport direction than the droplet discharging head.

7. The recording apparatus according to claim 6, further comprising:

a carriage unit that is configured to cause the charging unit to move, wherein the charging unit is capable of providing the electrical charge while being caused to move by the carriage unit.

8. The recording apparatus according to claim 1, further comprising:

a carriage unit that is configured to cause the charging unit to move, wherein the charging unit is capable of providing the electrical charge while being caused to move by the carriage unit.

9. A recording method comprising:

droplet discharging onto a medium from a nozzle forming portion including nozzles, the nozzles being formed in the nozzle forming portion, the droplets having a first polarity and the nozzle forming portion having a second polarity that is opposite of the first polarity; and electrical charge providing an electrically charge to the medium, the electrical charge providing, to the medium, a specific amount of an electrical charge having the second polarity, wherein the specific amount of the electrical charge provided to the medium is determined by one of:

for each specific time that the droplets are discharged, a discharge rate of the droplets discharged onto the medium during the specific time, or a maximum discharge rate of the droplets discharged onto the medium.

* * * * *